United States Patent [19]

Bouldin

[11] 4,363,870

[45] Dec. 14, 1982

[54] METHOD FOR MAKING A REFLECTIVE LASER RECORDING AND DATA STORAGE MEDIUM WITH A DARK UNDERLAYER

[75] Inventor: Eric W. Bouldin, Atherton, Calif.

[73] Assignee: Drexler Technology Corporation, Mountain View, Calif.

[21] Appl. No.: 301,203

[22] Filed: Sep. 11, 1981

[51] Int. Cl.[3] ..... G03C 1/02; G03C 5/54; G03C 5/26

[52] U.S. Cl. ..... 430/510; 430/246; 430/414; 430/415; 430/416; 430/616; 430/964; 346/135.1

[58] Field of Search ..... 430/246, 414, 415, 416, 430/616, 346, 964, 510; 346/135.1

[56] References Cited

U.S. PATENT DOCUMENTS

| | | | |
|---|---|---|---|
| 3,314,073 | 4/1967 | Becker | 346/76 L |
| 3,689,894 | 9/1972 | Laura et al. | 340/172.5 |
| 3,911,444 | 10/1975 | Lou et al. | 346/135.1 |
| 4,278,756 | 7/1981 | Bouldin et al. | 430/414 |
| 4,284,716 | 8/1981 | Drexler et al. | 430/510 |

OTHER PUBLICATIONS

Klein et al., "Color of Colloidal Silver Sols in Gelatin", *Photo. Sci. and Engr.,* vol. 5, No. 1, 2/1961, pp. 5–11.

*Primary Examiner*—Richard L. Schilling

[57] ABSTRACT

A method for making a laser recording and data storage medium by first exposing a Lippman emulsion to light in order to form a depthwise nuclei gradient, then physically developing the emulsion until a reflective surface layer of spheroid silver particles, having the desired degree of reflectivity, is attained and then chemically developing the remaining nuclei to form a dark underlayer of filamentary silver particles.

4 Claims, 6 Drawing Figures

EXPOSE - FORM NUCLEI

MONOBATH DEV. FOR ESTABLISHING NON-FILAMENTARY SILVER

STRONG CHEMICAL DEVELOPER FOR ESTABLISHING FILAMENTARY SILVER

METHOD FOR MAKING A REFLECTIVE LASER RECORDING AND DATA STORAGE MEDIUM WITH A DARK UNDERLAYER

DESCRIPTION

1. Technical Field

The invention relates to a process for making a reflective laser recording and data storage medium.

2. Background Art

The use of fine grain photo emulsion for the preparation of a reflective laser recording material was first disclosed by J. Drexler in U.S. patent application Ser. No. 131,288, generally corresponding to German Offenlegungsschrift No. 3,002,911. In that application, a processed black filamentary silver emulsion was converted to a reflective non-electrically conductive recording medium by heating at a temperature in the range of 250° C. to 330° C. in an oxygen containing atmosphere until the surface developed a reflective appearance. This laser recording material worked effectively with lasers of visible wavelengths, but its recording sensitivity fell by a factor of three for semiconductor lasers, which generate light in the near infrared at about 830 nm. The high temperatures of the process preclude the use of plastic film substrates commonly used for photographic films.

In U.S. Pat. No. 4,278,756 to E. W. Bouldin and J. Drexler, a reflective data storage medium is described. A reflective silver recording layer is derived from silver-halide emulsion through a silver diffusion transfer process. No heating was required to create the reflective surface; reflectivities up to 25% of green light were achieved. However, the recording sensitivity of this material was less than that of the process described in the aforementioned U.S. patent application Ser. No. 131,288, which yielded reflectivities up to 17%.

In U.S. Pat. No. 4,278,758 to J. Drexler and E. W. Bouldin, a reflective medium was disclosed derived from a silver-halide emulsion through a diffusion transfer process. In this medium the recording sensitivity at green laser wavelengths was greatly improved over that described in U.S. Pat. No. 4,278,756 and even somewhat higher than that achieved by the medium described in the aforementioned U.S. patent application Ser. No. 131,288. It was necessary, however, to add an annealing step at a temperature of 250° C. and above to achieve the desired results. Although the recording sensitivity was very good with a green laser at 514 nm and with a red laser beam at 633 nm, it fell off by a factor of three when the laser wavelength was increased to 830 nm.

In U.S. Pat. No. 4,284,716, Drexler and Bouldin addressed the problem of retaining recording sensitivity in the red and infrared wavelengths while retaining use of common plastic substrates through avoidance of the thermal annealing step. This was achieved by combining the two known forms of chemically reduced silver metal, spheroidal and filamentary, at the surface of the reflective recording material.

The process by which this was achieved involves use of fine grain photographic emulsion which is given a weak light exposure and then treated in a strong chemical developer. This developer contains no silver-halide solvent and thus proceeds through chemical development or "direct development" to produce amorphous filaments of silver metal, which are highly absorptive of red and near-infrared light. The photographic emulsion is then briefly contacted with a chemical fogging solution which is a strong silver ion reducer. Small silver nuclei are now created at the top of the emulsion surface because of the non-penetrating nature of the fogging solution's solvent and the briefness of the contact. When the photographic emulsion is immersed in a monobath containing a developing agent and a silver-halide solvent, silver ions from throughout the emulsion are transported to the thin layer of nuclei at the emulsion surface and there reduced to silver metal by the developing agent. Silver metal reduced from a solution onto nuclei is a process known as "solution physical development". The silver formed this way is often in the form of regular octahedrons or spheroids. When these spheroids are large and/or numerous enough, they can grow into each other to form agglomerates which by virtue of their regular faces or high volume concentration reflect visible and near-infrared light. This invention, then, made use of the absorptive filamentary silver in an intimate dispersion with reflective spheroidal silver to produce a sensitive laser recording material that could be prepared through room temperature chemistries.

This process has proved to be less than ideal in a manufacturing environment in several respects. There are no less than three washing steps overall and a mid-process drying step before the fogging solution to avoid uneven reflectivities. A problem of mottle or uneven reflectivities is aggravated by the variations across the plate in emulsion thickness. Areas of greater emulsion thickness had a higher concentration of silver ions to reduce on the nuclei and thus lead to areas of higher reflectivity. Uneven reflectivities would appear as electronic noise to a read laser tracking the surface at a fast rate. Mottle or variations in process uniformity were also introduced in the critically short fogging step and were dependent upon the efficiency of the post-fogging wash.

An object of the present invention was to devise a reflective direct read after write (DRAW) laser recording and data storage medium which could be manufactured in fewer steps, with smaller cost in terms of time and material, and with a greater degree of process uniformity in creating red and infrared reflectivities in the 20–50% range with minimal mottle.

DISCLOSURE OF INVENTION

The above object has been achieved by a new process for Lipmann emulsions. Such emulsions are commercially available as photoplates. The first step is to create a depthwise nuclei gradient, preferably by a uniform, saturating light exposure. Next, the nucleated emulsion is contacted by monobath, having a silver-halide solvent and a silver reducing agent, until spheroid particles which form the recording material's reflective layer have developed. Then the emulsion is contacted by a strong filamentary silver developer which creates a light absorptive, filamentary silver layer, as an underlayer beneath the reflective layer.

The result is a recording material, particularly sensitive in the red and infrared spectral regions.

BEST MODE FOR CARRYING OUT THE INVENTION

A. Starting Material

The starting material for making the reflective laser recording and data storage material is a silver-halide emulsion layer of the kind found on a commercially available black and white photoplate or black and white film product such as a strip film without a gelatin overcoat. Photoplates used for semiconductor photomasks or holographic recordings are preferred. Emulsion layers on such photoplates are characterized by uniform fine grain size and uniform thickness over a flat substrate, usually glass. Typical thickness is less than ten microns. The smaller the grain sizes of the silver-halide emulsion the higher the resolution of recording of the final product which results from the application of this invention. The emulsion grain size should be less than 5% to 10% of the recording hole size for best results. As is shown in the examples which follow, commercially available high resolution silver-halide emulsion photoplates used in making semiconductor integrated circuits are particularly useful in the practice of this invention. These photoplates, using Lipmann emulsions, have grain sizes primarily under 0.05 microns and will yield non-filamentary silver particles for the high resolution reflective layer produced in the final process step. The silver halide in such plates is held in a colloid matrix, normally gelatin. But the invention is by no means limited to these photoplates nor indeed is it limited to using only commercially available silver-halide photosensitive materials. Any photosensitive silver-halide emulsion with grain sizes primarily under 0.05 micron may be used in the practice of the present invention for high resolution laser recording. For lower resolution recordings the silver-halide grain sizes may be larger than 0.05 microns. For purposes of this patent application, the term "silver-halide emulsion" means a silver-halide emulsion without an added gelatin overcoat, unless an overcoat is specified.

B. Nuclei Formation

Figure 1:
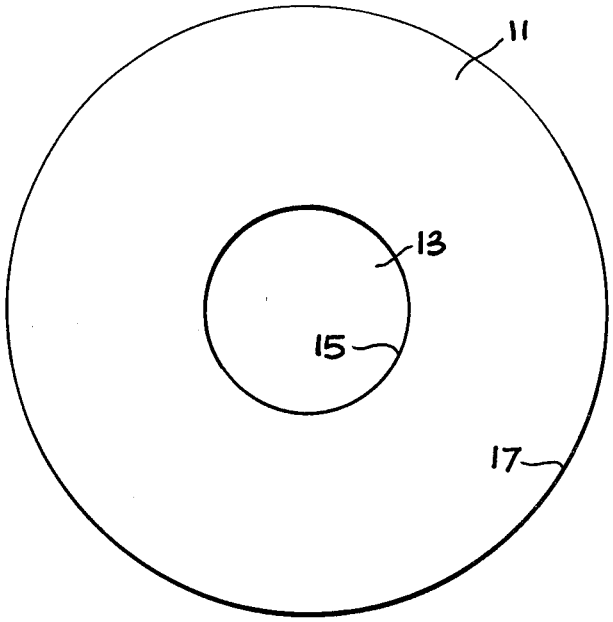
FIG. 1 is a top view of a disk shaped reflective laser recording and data storage medium.

FIG. 1 shows a disk shaped photoplate 11. A disk shape is preferable for rotating media, with the central aperture 13 serving as a centering device. Some or all of the surface between the inner circumference 15 and the outer circumference 17 may be used for recording or data storage.

Figure 2:
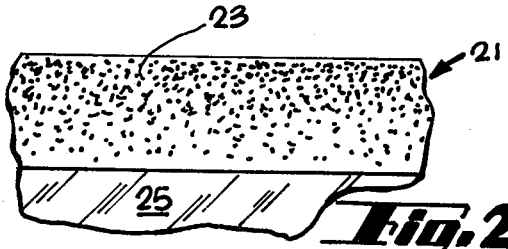
FIGS. 2–4 are sectional views of the results of processing steps for an emulsion in accord with the present invention.

The first step in the process of making the present invention is the creation of nuclei within the emulsion. Nuclei may be created by exposure of a silver-halide photosensitive medium to actinic radiation. This initial exposure is saturating, activating the entire thickness of the silver-halide emulsion which is exposed to light. This activation produces nuclei, illustrated as a uniform distribution in the horizontal plane of black dots in FIG. 2, forming a major surface which is within the emulsion layer and not clearly defined. This surface has not distinct lower boundary because nuclei extend downwardly to the emulsion-substrate interface. The greatest areawise density of nuclei is at this major surface, distal to the substrate, where light is not attenuated. The least areawise density of nuclei is distal to the major surface where light is most attenuated. A depthwise gradient exists between the upper major surface and the emulsion-substrate interface.

It has been suggested privately by another employee of the assignee of this application that a second set of nuclei may be formed by contacting the surface of the emulsion with borohydride, as by dipping, either before or after the actinic radiation exposure. This would increase the nuclei concentration on the surface and increase reflectivities at the shorter wavelengths. However, borohydride may contribute to dichroic fog. Its action is very fast and is hard to apply in an even amount. Borohydride may create mottle and is not preferred when red or infrared recording is desired.

The initial exposure may be obtained from room light, or from a brief exposure to an intense source of actinic radiation. Alternatively chemical fogging may be used in place of actinic radiation. Actinic radiation is the generic term which describes any exposure which creates a latent image. Latent image is the term which describes activation of unexposed silver halide. Exposure of the silver-halide photosensitive medium may be of uniform intensity over the surface of the medium, as illustrated by the nuclei pattern 23 in emulsion layer 21 in FIG. 2. This would yield a uniform areawise density of the latent images within the photosensitive medium.

An alternative to a uniform exposure and thus a uniform density of latent images is a patterned exposure of variable intensity. For example, the exposure of the silver-halide photosensitive medium may be composed of alternating concentric bands of high and low intensity actinic radiation over the surface of the photosensitive medium. By changing the intensity of the exposure in an alternating fashion, by means of a shielding mask having two degrees of transmissivity to the actinic radiation, the density of latent images within the photosensitive medium will differ in proportion to the intensity of the exposure levels. By patterning this differential exposure with higher and lower density latent images, it is possible to create a pattern of two different reflectivities, thereby prerecording certain information.

The emulsion is supported by a supporting substrate 25. This supporting substrate may be either glass or a polymer or ceramic material or metal. It is not necessary that this supporting substrate be transparent to either the exposing actinic radiation or to the radiation produced by the optical reading device. It is clear also that the combination of reflective silver coating over absorptive underlayer may be placed on both sides of such a supporting substrate. For example, it is possible and practical to use a photoplate which has disposed on its opposite sides silver-halide photosensitive material. The fact that the photosensitive material which finally results in the reflective silver coating over an absorptive substrate covers opposite sides of the supporting substrate has no detrimental effect on the utility of the final product and in fact provides twice the data storage capacity. The substrate should have a flat major surface on which the emulsion layer resides. While flatness is preferred, it is not essential.

C. Physical Development of Nuclei to Form Reflective Layer

The second step of the present invention involves contacting the nucleated emulsion with a monobath having a photographic developer of low reducing activity and an active silver-halide solvent, preferably thiocyanate. The procedure may be carried out in room light, except where pre-recording of information is desired. In the latter case, monobath development should take place in darkness. Contact may be by briefly dipping the emulsion in a tank containing monobath. In this manner, the emulsion surface distal to the substrate receives maximum monobath contact and the underlayer receives substantially less monobath contact, thereby leaving underlayer nuclei untreated.

Preferred monobath formulations for highly reflective surfaces include a developing agent which may be characterized as having low activity. The specific type of developing agent selected appears to be less critical than the activity level as determined by developer concentration and pH.

The developing agent should have a redox potential sufficient for causing silver ion reduction and adsorption or agglomeration on silver nuclei. The concentration of the developing agent and the pH of the monobath should not cause filamentary silver growth which gives a black low reflectivity appearance. The developed silver particles should have a geometric shape, such as a spherical or hexagonal shape which when concentrated form a good reflectivity surface.

Developing agents having the preferred characteristics are well known in the art and almost any photographic developing agent can be made to work by selection of concentration, pH and silver complexing agent, such that there is no chemical reaction between the developing agent and complexing agent. It is well known that photographic developing agents require an antioxidant to preserve them. The following are typical developing agent/antioxidant combinations which may be used in conjunction with a sodium thiocyanate (NaSCN) solvent complexing agent.

| For Monobaths Using Na(SCN) As a Solvent And Silver Complexing Agent | |
|---|---|
| Developing Agent | Antioxidant |
| p-methylaminophenol | Ascorbic Acid |
| p-methylaminophenol | Sulfite |
| Ascorbic Acid | — |
| p-Phenylenediamine | Ascorbic Acid |
| Hydroquinone | Sulfite |
| Catechol | Sulfite |
| Phenidone | Sulfite |

The following active solvents are preferred, besides thiocyanate: thiosulphates and ammonium hydroxide. These silver-halide solvents can be used individually or together in the form of a solvent co-system.

Figure 3:
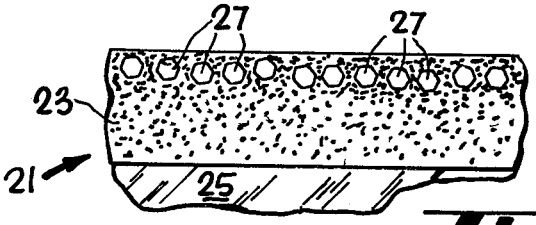

The monobath treatment is carried out until reflective spheroid particles and their agglomerates 27 in FIG. 3 are formed on the nuclei in the gelatin matrix. A greater density of silver spheroid particles occurs near the emulsion surface distal to the substrate because of the depthwise exposure gradient, created by actinic radiation, thereby forming a reflective surface layer.

The monobath treatment should leave some undeveloped silver halide due to low reducing activity of the developer. The monobath treatment is stopped as soon as a reflective surface layer has been formed and the desired amount of reflectivity attained.

D. Chemical Development of Nuclei to Form Dark Underlayer

Figure 4:
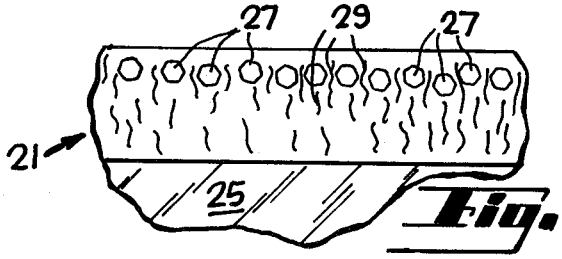

After the monobath treatment the nucleated and monobath treated emulsion is contacted with a strong chemical developer until the remaining silver halide is converted into black filamentary silver particles to form a light absorptive underlayer in said emulsion. Such developers are well known in black and white photography for their ability to produce black or dark gray filamentary silver layers from exposed silver halide. The preferred optical density is at least 1.0 for a 6 micron thick filamentary silver layer when measured with red light. The developer to be used is usually recommended by the manufacturer of the emulsion being used. Filaments 29 are seen in FIG. 4. A maximum amount of filamentary silver is desired. Most of the filamentary silver particles are beneath the major surface of the nuclei layer, although some are in the major surface. Nuclei beneath the major surface are sites for formation of filamentary silver particles.

This filamentary silver layer is a dark underlayer, beneath a surface reflective layer of non-filamentary particles. Recording of information relies upon contrast ratios between low reflectivity spots in a reflective field, if recording is from one side of the material. The reflective layer is non-electrically conductive, as well as low thermally conductive. This enhances the sensitivity of the material to laser recording, since recording energy is not laterally diffused. In the horizontal plane the filamentary silver particles are uniformly distributed on a statistical basis.

Figure 5:
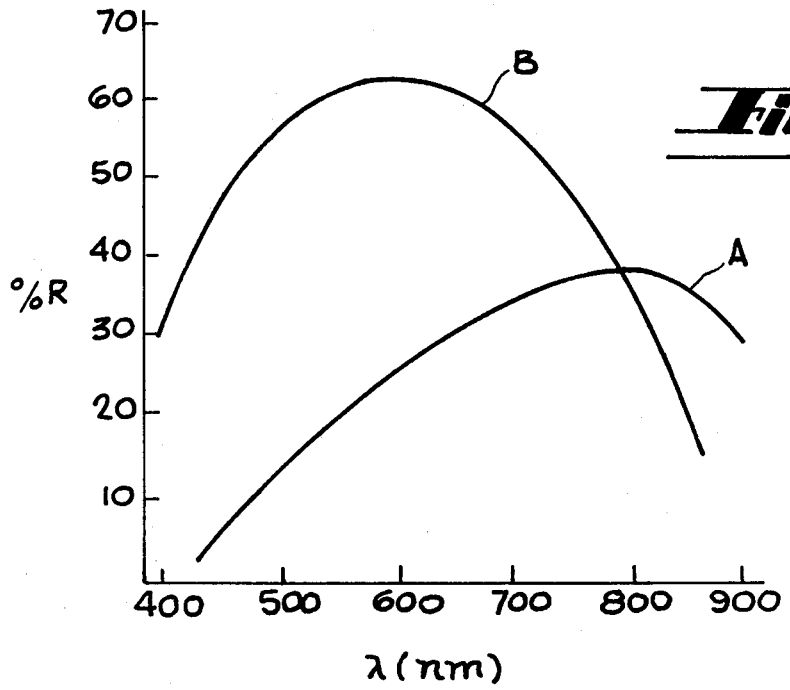
FIG. 5 is a plot of reflectivity of the medium of the present invention in comparison to a prior medium.

The laser recording and data storage medium of the present invention is similar but not identical to that produced by the method described in U.S. Pat. No. 4,284,716 because it displays different reflectivity curves across the visible spectrum, as may be seen in FIG. 5. In that figure, plot A shows the percent reflectivity of the present invention plotted against wavelength for light from a tunable source. Plot B shows reflectivity over the same wavelengths for the prior material. The present material has greater reflectivity beyond 780 nanometers and is relatively flat across the red and near-infrared spectral regions.

Figure 6:
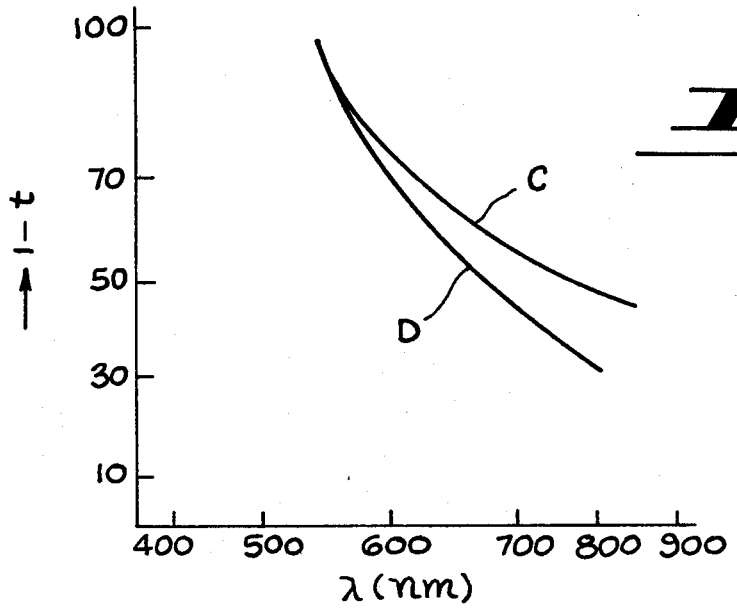
FIG. 6 is a plot of absorptivity of the reflective layer of the present invention in comparison to a prior medium.

While both materials use spheroid and filamentary silver particle dispersions, they are materially different in spheroid size or concentration. The absorption characteristics of the reflective components from the two laser recording materials were measured. The reflective component of the present invention was isolated, as the monobath treated plate that had been fixed with thiosulfate rather than immersed in the chemical developer. The reflective component of the previously reported material was isolated by bleaching the filamentary component before formation of the reflective spheroids with the chemical fogger and monobath. In FIG. 6, absorption (1-t where t represents light transmission) is plotted against wavelength. Plot C indicates the medium of the present invention, while Plot D indicates the medium in U.S. Pat. No. 4,284,716.

The absorption curves of the present material do not match any of the known curves which characterize spheroids of uniform size, for example, as shown in Klein and Metz, P.S.&E., Vol. 5, A61. It is no doubt true that the reflective components of the present laser material are made up of spheroids of varying sizes with the larger particles forming agglomerates at the surface. What is less clear is the source of the increased absorptivity of the isolated reflective component of the present invention over that of U.S. Pat. No. 4,284,716. It can be due to particles of the larger size being present, or because of the similar nature of the curves, a larger concentration of similarly sized particles. Perhaps both factors are at work here. In any event, the reflective component of the present invention is more absorptive of red and infrared radiation. The slightly higher red and infrared absorption of the new material lead us to conclude that it will be better than or equal to the prior material in recording sensitivity at these wavelengths.

This invention, then, relates a method of preparing a similar sensitive surface with fewer processing steps than in the case where the filamentary component is prepared prior to the chemical fogging and monobath development of the reflective component. The material formed by the method of the present invention, where the reflective component is formed first and subsequently filled in with the filamentary silver, is very clean and free of particulate pollution in the form of dichroic fog. This is because the monobath contains a smaller amount of the organic reducing agent required to reduce the solvated silver ions to the metal spheroids, and thus requires a smaller amount of the silver ion solvent, lest the silver ions all escape past the nuclei to the solution before the reduction takes place. In monobaths with a higher concentration of the silver ion solvent, some of the ions do escape past the nuclei and are reduced in the solution by the stronger developer to particles of silver, known in photography as dichroic fog.

E. Mode of Use

The resulting mirror-like coating on the substrate is suitable for laser recording, using a helium-neon laser having a red line at 633 nanometers. The laser beam diameter is typically less than one micron at the surface of the medium, with pulse lengths on the order of 100 nanoseconds. A shallow pit, penetrating the reflective layer, but not the underlayer, is formed by melting the reflective surface of the gelatin. The reflectivity of the hole or pit is then read by comparing the reflectivity of an adjacent non-pitted area. A comparison of these reflectivities leads to a relative contrast ratio measurement. Reflected light is read by a silicon cell, or by a photo multiplier tube. Frequently the recording medium will be rotated beneath a beam for recording or reading purposes. In this case, the recording medium is made in the shape of a disk, as shown in FIG. 1, with the central aperture used as a centering device on a spinner mechanism. In reading the disk, lower laser power is used than in writing, so that the surface of the disk will be illuminated, but melting will not occur.

F. Examples

The following examples are representative of the results derived from the process of this invention. Reflectivity measurements were made with the spectral reflectivity attachment to a Beckman DU-8 spectrophotometer, 20° incident angle. Absorption measurements were also made with the Beckman DU-8 spectrophotometer.

EXAMPLE 1

A commercial Konishiroku SN photoplate with an emulsion thickness of 6 microns was exposed to room light. After the plate was soaked in de-ionized water for one minute to promote even emulsion swelling, it was immersed in a monobath of $Na_2SO_3$ 10 g, NaOH 2 g, Elon 0.5 g and NaSCN 10 g; with water added to bring the volume to 1 liter. The plate was constantly agitated for 2 minutes. After washing, the plate was developed for 1 minute in a solution of $Na_2SO_3$ 36.9 g, hydroquinone 7.9 g, KOH 7.4 g, KBr 2.7 g, benzotriazole 0.07 g; with water added to bring the volume to 1 liter. After washing and warm air drying, the plate is very uniformly reflective areawise with the following characteristics:

| 830 nm | 780 nm | 633 nm | 514 nm | 440 nm |
|---|---|---|---|---|
| Reflectivities | | | | |
| 40% | 39% | 32% | 23% | 18% |
| Absorption | | | | |
| >59% | | >67% | | |

EXAMPLE 2

An Agfa Millimask HD emulsion 4.5 microns on a glass substrate was exposed and processed in a similar manner. In room light, the plate was washed for one minute in de-ionized water. It was then developed with constant agitation in a monobath of: $Na_2SO_3$ 10 g, NaOH 1 g, Elon 0.5 g, NaSCN 10 g; water added to bring volume to 1 liter. After washing, the plate was developed in the black filamentary developer of: $Na_2SO_3$ 36.9 g, hydroquinone 7.9 g, KOH 7.4 g, KBr 2.7 g, benzotriazole 0.07 g; with water added to bring volume to 1 liter. After washing and warm air drying, the plate was found to have the following properties:

| 830 nm | 780 nm | 633 nm | 514 nm | 440 nm |
|---|---|---|---|---|
| Reflectivies | | | | |
| 52% | 51% | 43% | 34% | 24% |
| Absorption | | | | |
| >47% | | >56% | | |

EXAMPLE 3

An Eastman Kodak type 1 A photoplate, 6 micron emulsion, was processed into a laser recording material in the following manner: Plate was washed for one minute in room light, developed in the monobath of Example one for two minutes, and developed in the black developer of the previous two examples for one minute. After washing and drying, the plate was found to have the following properties:

| 830 nm | 780 nm | 633 nm | 514 nm | 440 nm |
|---|---|---|---|---|
| Refectivies | | | | |
| 50% | 47% | 36% | 25% | 15% |
| Absorption | | | | |
| >49% | | >63% | | |

EXAMPLE 4

Contact printed images. Konishiroku SN photoplate was exposed through a microlithographic mask for 5 seconds at an exposure level of 10 L/ft$^2$ on an Ultratech CP-210 contact printer. It was processed in total darkness in the same manner as in Examples 1, 3 and 4. The plate was found to have faithfully reproduced 1 micron geometries in black silver surrounded by a field of reflective silver with the following characteristics:

| 830 nm | 780 nm | 633 nm | 514 nm | 440 nm |
|---|---|---|---|---|
| Refectivies | | | | |
| 24% | 23% | 19% | 14% | 7% |
| Absorption | | | | |
| >75% | | >80% | | |

Reflectivities can no doubt be raised by adjusting the light exposure.

I claim:

1. A method of making a reflective laser recording and optical data storage medium comprising, forming a layer of silver precipitating nuclei from a portion of the silver halide within a fine-grained, photosensitive silver-halide emulsion layer of uniform thickness, disposed on a substrate, the nuclei layer having a major surface distal to the substrate with a depthwise nuclei gradient with greatest nuclei density distal to the substrate, contacting said nucleated emulsion layer with a monobath solution comprising a silver-halide solvent and a low-activity silver-reducing agent of sufficient concentration to cause another portion of silver halide to form soluble silver ion complexes and be transported by diffusion transfer to said precipitating nuclei, where said silver ion complexes are reduced to non-filamentary silver particles to form a reflective surface layer in said emulsion layer without causing reduction of silver ions in the solution, contacting said nucleated and monobath-treated emulsion layer with a strong chemical developer whereby remaining silver halide is converted into black filamentary silver particles to form a light absorptive underlayer in said emulsion layer.

2. The method of claim 1 wherein said nuclei layer is formed by exposure to light.

3. A method of making a reflective optical data storage medium comprising, forming a layer of silver precipitating nuclei from a portion of the silver halide within a fine-grained photosensitive silver-halide emulsion layer of uniform thickness disposed on a substrate, the nuclei layer having a major surface distal to the substrate with a depthwise nuclei gradient with greatest nuclei density distal to the substrate, contacting said nucleated emulsion layer with a monobath comprising concentrations of an active silver-halide solvent and a photographic developer of low reducing activity such that reflective spheroid particles and agglomerates are formed on the nuclei in said nuclei layer without causing reduction of particles and agglomerates in the solution, and contacting said nucleated and monobath-treated emulsion layer with a strong chemical developer until the remaining silver halide is converted into black filamentary silver particles to form a light absorptive underlayer in said emulsion layer.

4. The method of claim 3 wherein said nuclei layer is formed by exposure to light.

* * * * *